United States Patent [19]

Stone et al.

[11] Patent Number: 4,798,309

[45] Date of Patent: Jan. 17, 1989

[54] PROGRAMMABLE DISPENSING APPARATUS FOR PILLS OR THE LIKE

[75] Inventors: Forrest D. Stone, Salt Lake City, Utah; John M. Trondsen, 7521 32nd NE., Seattle, Wash. 98115

[73] Assignee: John M. Trondsen, Seattle, Wash.

[21] Appl. No.: 46,729

[22] Filed: May 7, 1987

Related U.S. Application Data

[63] Continuation-in-part of Ser. No. 841,198, Mar. 19, 1986, abandoned.

[51] Int. Cl.[4] ..... B65D 83/04

[52] U.S. Cl. ..... 221/4; 221/15; 221/82; 221/195

[58] Field of Search ..... 221/2, 3, 4, 5, 15, 221/12, 82, 83, 86, 195, 196; 364/479; 206/534, 538, 539, 533

[56] References Cited

U.S. PATENT DOCUMENTS

| | | | |
|---|---|---|---|
| 1,696,795 | 12/1928 | Cutler | 221/83 X |
| 4,223,801 | 9/1980 | Carlson | 221/15 X |
| 4,360,125 | 11/1982 | Martindale et al. | 221/2 |
| 4,381,059 | 4/1983 | Schurman | 221/91 X |
| 4,473,884 | 9/1984 | Behl | 221/3 X |
| 4,504,153 | 3/1985 | Schollmeyer et al. | 221/2 X |
| 4,572,403 | 2/1986 | Benaroya | 221/3 |
| 4,573,606 | 3/1986 | Lewis et al. | 221/3 X |
| 4,695,954 | 9/1987 | Rose et al. | 221/3 |

FOREIGN PATENT DOCUMENTS

| | | | |
|---|---|---|---|
| 380926 | 9/1932 | United Kingdom | 221/86 |

*Primary Examiner*—F. J. Bartuska
*Attorney, Agent, or Firm*—Philip A. Mallinckrodt; Robert R. Mallinckrodt

[57] ABSTRACT

A programmable machine for dispensing items, such as pills or capsules, in timed sequence has a cylindrical container element provided with a series of item receiving and dispensing compartments extending spirally therealong and opening into its circumferential surface for alignment with a discharge opening in a stationary cylindrical shell within which the container element is mounted for both rotary and axial movement concentrically over and along a microprocessor controlled, stepper motor, so as to sequentially bring the individual compartments into precise alignment with the discharge opening of the shell to discharge their contents into a delivery tray. The container element is mounted for spiral movement on and along a stationary spiral trackway as it is rotated. The compartments may be filled by turning the machine upside down and inserting items through the discharge opening.

5 Claims, 3 Drawing Sheets

PROGRAMMABLE DISPENSING APPARATUS FOR PILLS OR THE LIKE

RELATED APPLICATION

The present application is a continuation-in-part of our similarly entitled copending application Ser. No. 841,198, filed Mar. 19, 1986 now abandoned.

BACKGROUND OF THE INVENTION

1. Field

The invention relates to dispensing apparatus for medications, such as pills and vitamins, or for other items to be either consumed or used at set intervals.

2. State of the Art

Various devices have been developed heretofore for automatically dispensing pills at pre-established intervals in accordance with schedules prescribed by physicians and for alerting the user to various conditions of operation, see particularly U.S. Pat. Nos. 4,360,125, 4,381,059, 4,473,884, and 4,504,153. Yet, there has remained a need for more versatility and use of standard commercially available parts in machines of this type.

In the copending application of Forrest D. Stone, Ser. No. 831,810 filed Feb. 21, 1986 entitled "Electronically Controlled Programmable Dispenser for Medications", there is disclosed a versatile machine capable of being programmed to automatically dispense required dosages of medications, such as various kinds of pills, capsules, and the like, sequentially at selectively timed intervals over an extended period of time, e.g. a week.

We have now gone farther in developing a simpler machine that is more economical to manufature and more convenient to use, but which utilizes the novel combination of electrical stepper motor means and programmable control system therefor as part of the general type of dispensing apparatus concerned, which combination was due to our joint efforts but was first incorporated in the machine construction that was developed solely by the present joint inventor, Forrest D. Stone, and is disclosed in his aforesaid copending sole application Ser. No. 831,810.

BRIEF SUMMARY OF THE INVENTION

In accordance with the present invention, a cylindrical container element is provided with a sprial series of item-receiving compartments opening into such container element from the outer circumferential surface thereof and extending in spiral formation from end-to-end thereof. The container element is mounted on a horizontal axis of rotation for sprial movement along such axis within a stationary tubular shell having an item-discharging opening in its bottom above an item-delivery tray, which may be moved out of the way if the compartments are filled through such bottom discharge opening. Sequential dispensing is effected as filled compartment after filled compartment along the spiral series comes into registry with the discharge opening.

Spiral movement of the container element along its axis of rotation is advantageously achieved by rotatably mounting such container element on a stationary, supporting, cylindrical cam having a spiral groove trackway into which a cam follower pin projects from fixed anchorage in the container element. A reversible stepper motor has its output shaft coupled to the container element in a way that accommodates concentric longitudinal travel of such container element as rotary motion is imparted thereto.

Spiral travel of the container element within the shell is effected by the stepper motor controlled on a programmed basis by microprocessor means included in an information storage and control system essentially similar to that disclosed in the aforesaid copending patent application of Forrest D. Stone and set forth in detail hereinafter.

THE DRAWINGS

The best mode presently contemplated for carrying out the invention in actual practice is shown in the accompanying drawings, in which:

FIG. 1 is a view in front elevation of a programmable medication dispenser in accordance with the invention, a portion of the shell being broken away to show the container element in elevation;

FIG. 2, an end elevation looking from the left in FIG. 1, with portions of the end wall broken away to show otherwise hidden parts;

FIG. 3, a fragmentary, longitudinal, vertical section taken on the line 3—3 of FIG. 2, with the cylindrical cam shown in elevation;

FIG. 4, a fragmentary horizontal section taken on the line 4—4 of FIG. 2; and

FIG. 5, a block diagram of the programmable control system.

DETAILED DESCRIPTION OF THE ILLUSTRATED EMBODIMENT

Figure 4:
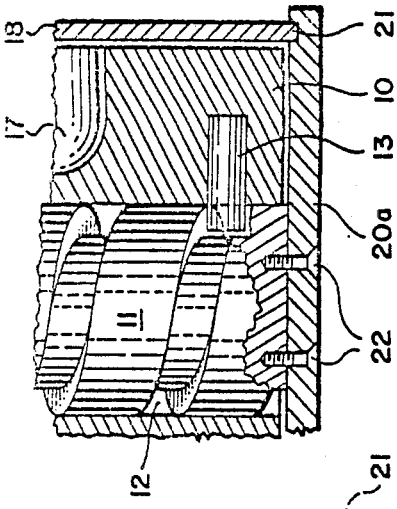

In the form illustrated, a cylindrical container element 10 of tubular formation is rotatably mounted on a stationary cylindrical cam 11 for travel therealong in either direction as it rotates. To this end, cam 11 is provided with a spiral trackway groove 12 into which projects a cam follower pin 13 from fixed anchorage in container element 10.

A reversible stepper motor 14 is positioned at one end of cam 11 and has a drive hub 15 attached to its output shaft **14*a* with lugs 15*a* fitted into respective longitudinal receiving slots 16 opening at the confronting end of container element 10** and continuing longitudinally thereof along the length of such container element to both transmit rotary movement to such container element and accommodate axial, i.e. concentric, back and forth movement thereof during rotation.

As motor 14 rotates container element 10 in either direction, cam follower pin 13 causes such container element to travel longitudinally along stationary cylindrical cam 11 from end-to-end thereof in a direction depending upon the direction of rotation of motor 14.

Container element has a spiral series of recesses 17 closed at their bottoms and opening outwardly circumferentially from end-to-end thereof as itemreceiving compartments. These compartments are normally closed circumferentially of the container element by a stationary tubular shell 18, into which container element 10 is closely but rotatably fitted. For filling and dispensing purposes, shell 18 is provided with an opening 19 similar to those of the compartments 17. The openings of compartments 17 are brought into registry with opening 9 sequentially as container element 10 is rotated and moved longitudinally. However, filling could be carried out advantageously without turning the machine upside down by providing an opening (not shown) corresponding to 19 but located in the forward upper part of shell 18.

Shell 18 is fixedly mounted within a supporting and protective structure 20 in any suitable manner, as, for example, by having its open ends fitted and secured in circular grooves 21 formed in the inside faces of end walls 20*a* and 20*b*, respectively, of such structure. Cam 11 is also fixedly mounted in structure 20 in cantilevered fashion, as by capscrews 22 extending thereinto through end wall 20*a*. Motor 14 is likewise fixedly mounted in cantilevered fashion, as by capscrews 22 extending through end wall 20*b*.

Figure 3:
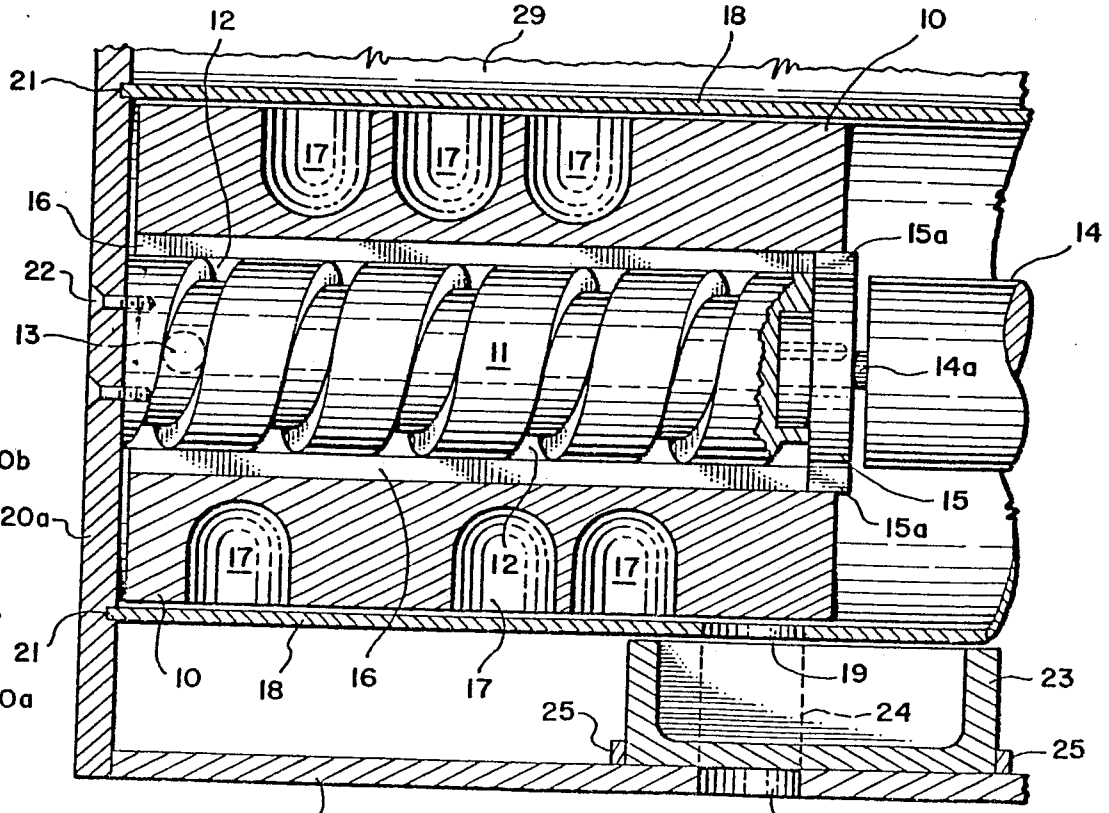
Figure 2:
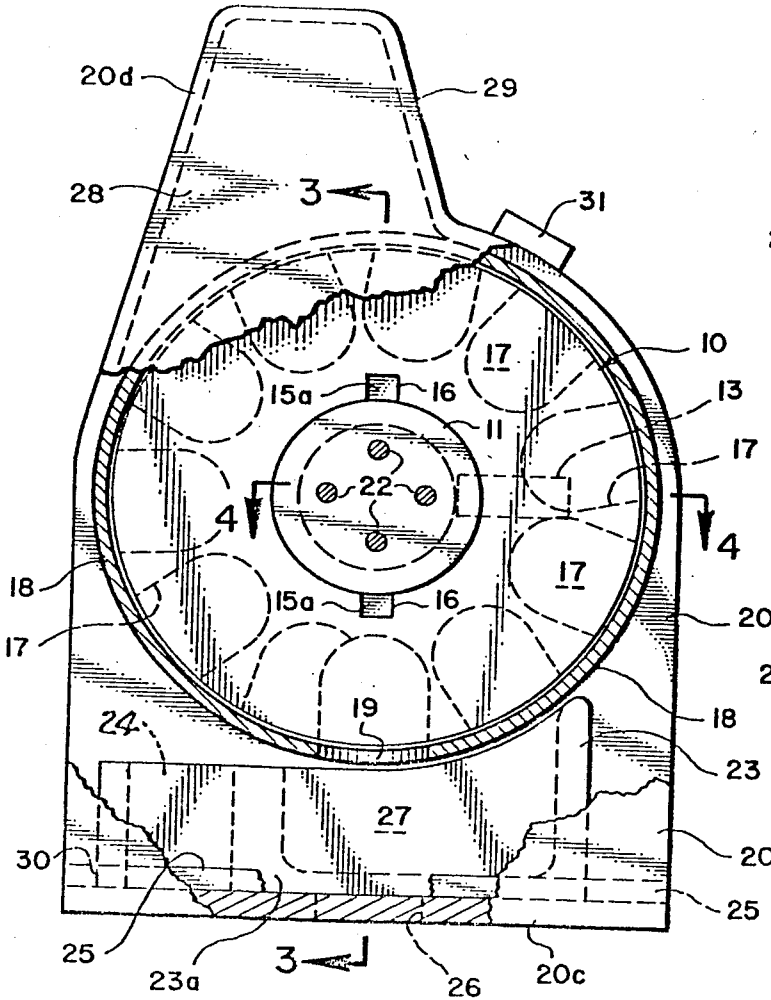

Within structure 20 is a delivery tray 23, normally positioned under discharge opening 19, as in FIG. 3, but, as shown in FIG. 2, having a rearwardly extending arm 23*a* provided with a through-passage 24 for positioning under such opening 19 when compartments 17 are to be filled. As here shown, delivery tray 23 is slidably attached to floor 20*c* of structure 20, as by means of rails 25, which provides for alternate positioning of such tray as required for compartment filling and for compartment dispensing, the former when the tray is pulled out and throughpassage 24 in arm 23*a* is aligned with opening 19 of shell 18 and with an opening 26 in floor 20*c* of structure 20, and the latter when pick-up recess 27 of delivery tray 23 is directly under such opening 19. Following compartment dispensing at any given time, the user need merely slide tray 23 forwardly through the open front of structure 20 to obtain access to the item or items that had been dispensed from one or more of the compartments 17.

Figure 5:
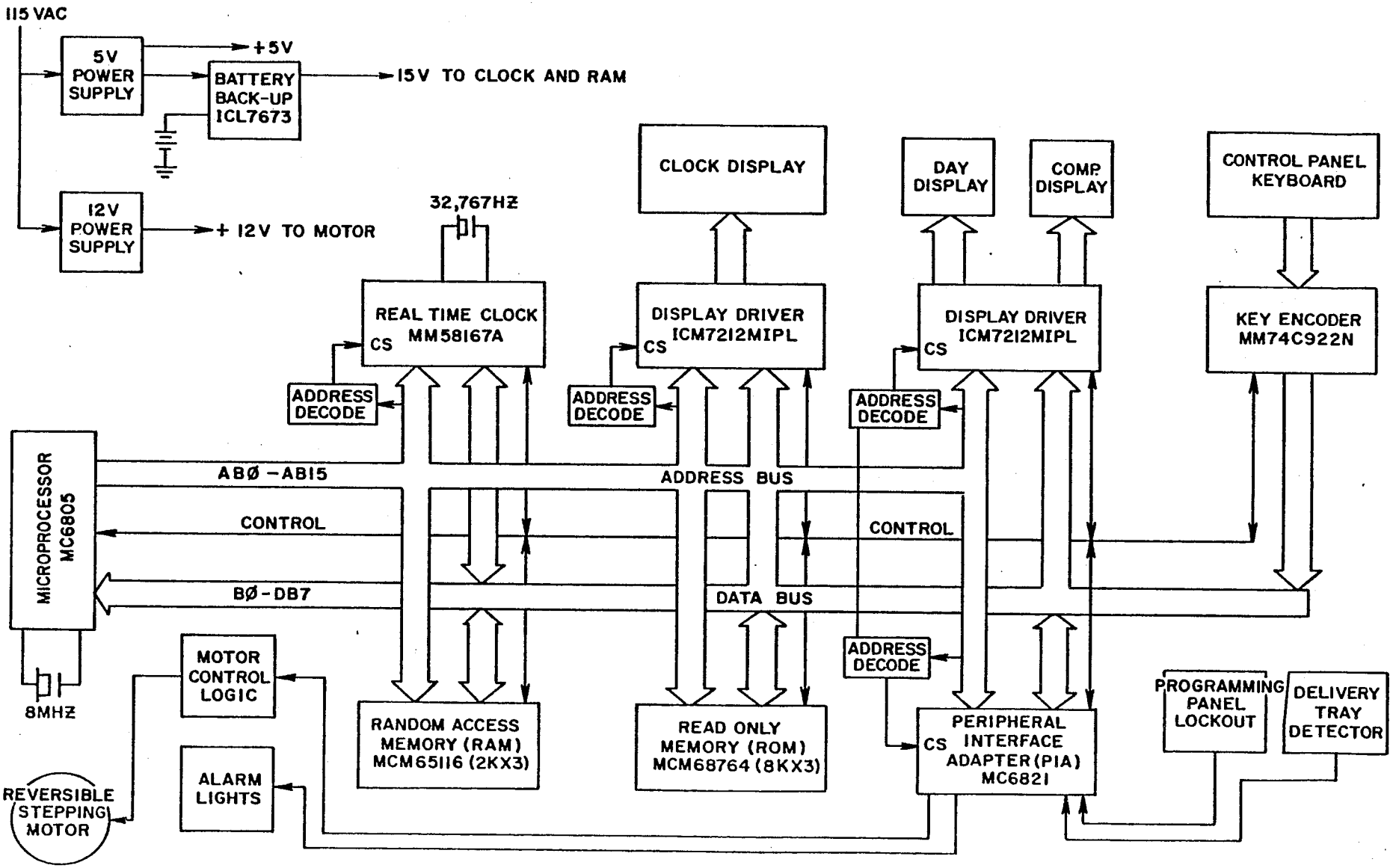

For conveniently housing operative components of a programmable information storage and control system, indicated generally at 28, FIG. 2 and specifically in FIG. 5, by which the mechasnism previously described is programmed, and, for providing a visually convenient control and display panel 29, structure 20 has an upwardly extending housing portion 20d, the panel 29 constituting its front wall.

Filling of compartments 17 is accomplished in the illustrated embodiment by pulling delivery tray 23 out so that through-passage 24 is in alignment with both shell opening 19 and structure 20's bottom wall opening 26, after which the entire machine is turned upside down and the lower COMP push button on panel 29 is pushed to place the first compartment 17 in alignment with the aligned through-passage and discharge openings, whereupon the proper time or items for the initial dispensing is or are inserted. Container element 10 is then rotated sequentially by pushing the upper COMP button from compartment to compartment, which compartments are filled with the proper items for subsequent dispensing. Upon completion of filling, the machine is turned right-side-up and properly programmed for a week's periodic dispensing of the contained items. Information displayed on panel 29 is desirably the same as displayed by the system of copending application Ser. No. 831,810, and control push buttons are provided accordingly. Although filing is here accomplished by turning the machine upside-down, a filling aperture could be provided adjacent to the top of shell 18 for filling while the machine is right-side-up.

The information storage and control system 28 includes a microprocessor that controls stepper motor 14 in accord with all time intervals (from hour to hour and day to day) by sequential periods of rotation of container element 10 in the same direction. To provide for dispensing of an item or items, for example, at up to six designated times per day over a seven day period, container element 10 has forty-two compartments 17 spaced in spiral formation over a convenient length for container element 10, e.g. five and a half inches based on an outside diameter of four and a half inches. In applications in which three or less dispensing compartments are required per day, the machine can be programmed for a two week period, and, if desired, the container element can be lengthened and more compartments provided to extend the overall period.

Upon completion of filling, the machine is turned right-side-up and properly programmed for a week's periodic dispensing of the contained items. As previously indicated, information displayed on panel 29 is desirably the same as displayed by the system of copending application Ser. No. 831,810, and control push buttons are provided accordingly.

Once the required pills or other items are appropriately placed in compartments 17 of cylinder 10 in accordance with the prescribed sequence of taking by the user of the apparatus, the automatic control system is properly programmed from a time standpoint. As shown, the control system is provided in the form of monitoring and microprocessor means using the display panel 29.

The control system advantageously employs monitoring means in the form of an electical limit switch placed at 30, FIG. 2, to detect opening of delivery tray 23. A key-operated master switch is located, for example, at 31, FIG. 2, and is arranged to permit manual programming and activation of stepper motor 14, by means of the push button switches shown in FIG. 1 as part of display panel 29, only when in the unlocked position. The control system also employs microprocessor means for controlling the stepper motor 14 to carry out the events on a programmed basis and activates userinformation means, e.g. the lights shown in FIG. 1 as a visual display portion of display panel 29, to alert the user to various stages of operation.

Figure 1:
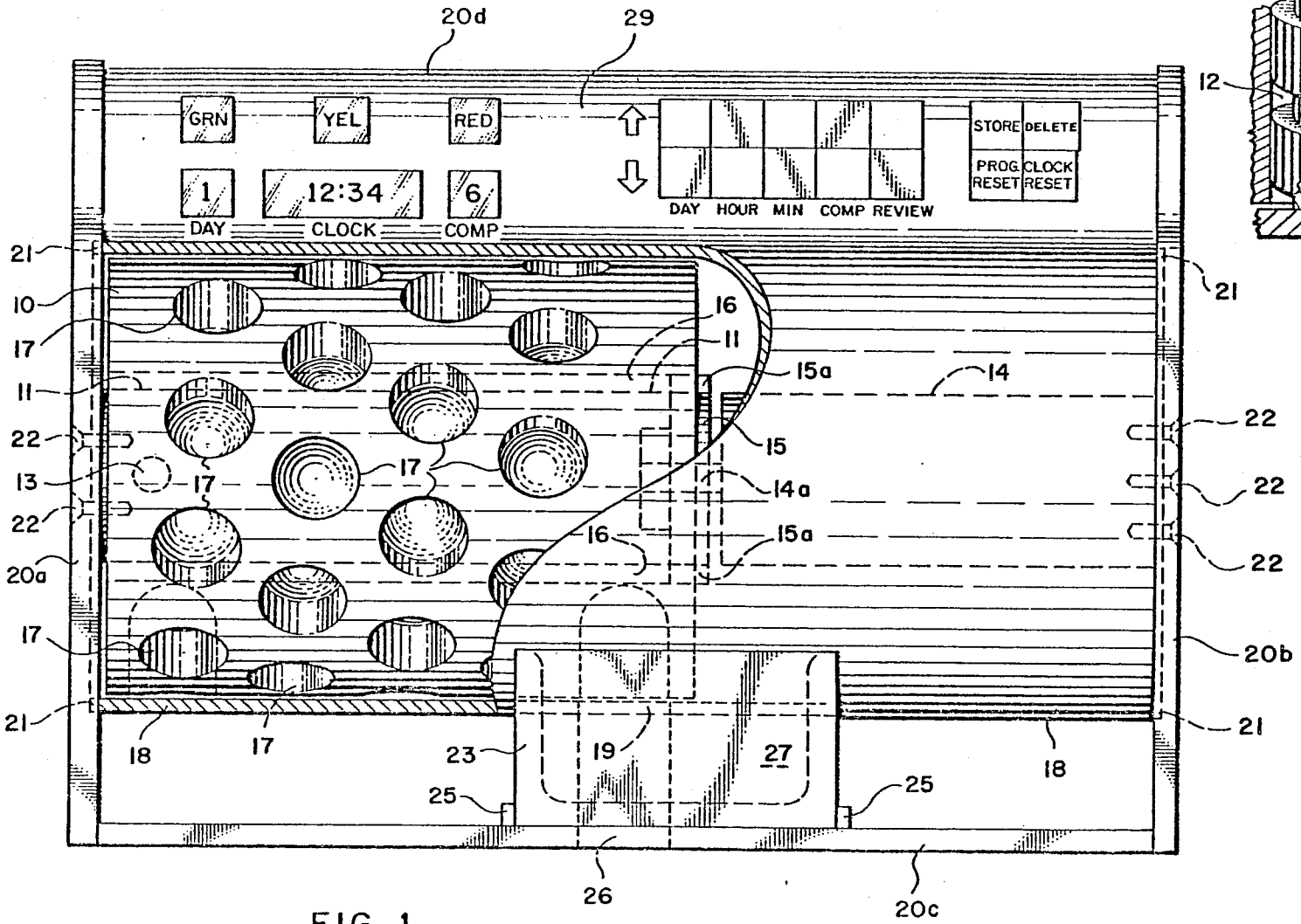

As indicated in the full face showing of display-control panel 29 in FIG. 1, the day, time of day, and the particular compartment 17 in cylinder 10 are shown by the side-by-side windows constituting the second line of the visual display. The lights comprise three side-by-side windows constituting the first line of the display as green, yellow, and red lights, respectively, to indicate, respectively, for example, when steady, that all dispensed items have been removed from the machine, that dispensed items are waiting to be removed, and that dispensed items have been waiting for removal over a predetermined length of time, and, when flashing, that a full cycle of operation has been completed, the machine is inoperable, and that the machine has shut down to aovid overdosing in instances of critical drugs.

Banks of control push buttons, FIG. 1, for use in operating switches to program the machine are adjacent to the windowed displays in panel 29 and are only operable when the machine is unlocked.

A programmable monitoring and control system for the machine is shown by the block diagram of FIG. 5. As there indicated, a standard type of microprocessor is programmed by the user by pushing the control buttons in display panel 29. The program is stored in a Read Only Memory (ROM) and in a Random Access Memory (RAM). The microprocessor uses Peripheral Interface Adapter (PIA) to control stepper motor 14 via Motor Control Logic. The PIA also controls the Alarm Lights and reacts to the delivery tray switch 30 and to the switch actuated by the Display Panel Lockout 31.

All real time automatic control is based on time output from the integrated circuit controlling the Real Time Clock. Power to the Motor Control Logic is provided by a 5 volt DC Power Supply and a 12 volt DC Power Supply. In the event of failure of the usual 115 volt AC power supply, the Real Time Clock and the RAM are powered by battery via a Battery Back-Up circuit, which prevents loss of real time and stored programming instructions. Commercially available integrated circuits are identified by manufacturers' designations, although functionally equivalent circuits may be obtained from other manufacturers under different identification numbers.

The microprocessor interfaces with the system components via the Address Bus, the Data Bus, and the Control Bus (each identifed as such in the drawing). After the requested device is selected by decoding the Address Bus lines, the microprocessor either applies data to the Data Bus or reads data from the Data Bus, depending on the nature of the selected system component. The Control Bus passes read/write and interrupt commands between the microprocessor and the system components. The speed of microprocessor operation is determined by an 8 MHZ crystal.

Real Time is generated by the integrated circuit of the Real Time Clock and is based on a 32,768 HZ crystal. The real time hours and minutes generated are read by the microprocessor via the Data Bus. The control program causes the microprocessor to apply the address of the Real Time Clock at the Address Bus every few milliseconds. An Address Decode recognizes the address and applies the time in hours and minutes on the Data Bus, which is then read by the microprocessor, which next addresses a Display Driver and sends the real time data out the Data Bus to be stored in the Display Driver for driving the Clock Display in twenty-four hour format. The microprocessor compares the real time to the values that were stored in the RAM during the manual programming sequence to determine if some operation is required. By using this technique, the timing of pill dispensing, alarm lights, and advance of pick-up tray 23 can be controlled to one minute accuracy.

In use of the device, the day is read by the microprocessor from the Real Time Clock and is transferred to the Display Driver for Day and Compartment to light the Day display window in display panel 29. The compartment number is determined by the microprocessor from a counter in the RAM, but, during filling, is advanced when the command is sent to stepper motor 14 by the user manually pushing the lower one of the buttons labeled COMP in the bank of the push buttons.

Output of the Control Panel Keyboad (the banks of push buttons, FIG. 1) is decoded by a Key Encoder circuit. Each time a push button is actuated, an interrupt signal is sent to the microprocessor, which causes the control program stored in the ROM to read the output from the Key Encoder and to perform the requested operation.

Two physical conditions of the dispensing mechanism are monitored and used by the control program as indications of required action. These conditions are delivery tray open, detected by switch 30, and display panel unlocked, detected by the key lock switch 31. In both conditions, an interrupt signal is sent to the microprocessor via the PIA, which causes the control program to branch to the required location for the requested operation, namely, actuation of stepper motor 14, opening of delivery tray 23 for pick-up of dispensed items, and unlocking of lock 31 at the end of an operative cycle.

An Alarm Lights of display panel 29, FIG. 1, are controlled by the microprocessor via data sent to the PIA.

Compartment positioning is accomplished by stepper motor 14 through commands generated by the microprocessor control program and transmitted to the Motor Control Logic via the PIA.

To prepare the machine for dispensing pills, vitamins, and/or other medications in accordance with any prescribed amounts and scheduling of administration of such amounts throughout a total of six periods within a twenty-four hour day repeated for a total of seven days, compartments 17 must be properly loaded with the times to be periodically dispensed. This is accomplished as previously described.

For programming the system in accordance with the prescribed operating schedule, the CLOCK in display 29 is set to the correct time (if this has not been done prior to the loading operation) by pushing the appropriate hour and minute buttons of bank 40 for actuating either the increment (top row) or decrement (bottom row) switches thereof. The CLOCK display will start flashing. When the clock reset switch is pushed, the CLOCK display will stop flashing. The progress reset button is then pushed to actuate its switch and the DAY, CLOCK, and COMP displays will start flashing. The DAY increment and decrement switches are then set to the day, time, and compartment values for the first day of dispensing by pushing the corresponding buttons, whereupon the store button is pushed to activate its switch and store the values set for that first day. This programmed sequence will then be automaticaly repeated for successive days of the total time period.

It should be understood that only the number of compartments 17 required for the medication administering schedule will be filled with medication. These will be successive compartments around the spiral, commencing with the first compartment identified by the appearance "1" in the COMP window of the display. The same is not true, however, for the days in the week. In any day is to be skipped in the administering of medication, the machine will still go through the programmed sequence with unfilled cylinders as well as with those that are filled.

Upon the dispensing of medication into delivery tray 23, the yellow light of the display will appear steadily in its viewing window. If the dispensed medication is not picked up from the delivery tray within a prescribed time, the yellow light will go out and the red light will appear steady in is window. When the dispensed medication is picked up, the green light will appear steadily in its window.

When a full week's cycle of operation has been completed by the machine, the green light with flash on and off. If the machine becomes inoperable during the normal operating cycle, the yellow light will flash on and off, and if the machine has shut down because dispensed medication has not been picked up and more than one of the scheduled doses thereof have accumulated in the delivery tray at any given time, the red light will flash on and off.

The combination of a reversible stepper motor and a microprocessor in a programmable control system in item dispensing mechanism enables the construction of precisely performing mechanism with maximum compactness and at minimum expense.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. Apparatus for dispensing a multiplicity of items in sequence, comprising an elongate cylindrical container element; means mounting said container element for simultaneous rotation and axial movement on a substantially horizontal axis so that any point on its circumferential surface executes progressive spiral travel; means for effecting said rotation and axial movement comprising a reversible stepper electric motor and along which said container element moves concentrically back and forth during its spiral travel; a series of recesses in said container element opening into the outer circumferential surface thereof and extending along the length thereof in spiral formation on item-receiving compartments; an item-retaining shell within which said container element is closely fitted for said rotation and axial movement, said shell having a dispensing opening substantially corresponding to a compartment opening, said dispensing opening being located within the path of spiral travel of the series of compartment openings; and a programmable information storage and control system including microprocessor means for operating the means for effecting rotation and axial movement of the container element on a sequentially timed basis; said electric motor having a power output shaft with a hub that is provided with oppositely extending lugs, the container element being provided internally with longitudinal slots engaged by said lugs, respectively, said lugs and said slots comprising back and forth guiding means.

2. Apparatus according to claim 1, wherein the container element, the means for effecting movement of said container element, and the item-retaining shell are mounted within a supporting and protective structure having an open front and wherein the dispensing opening faces downwardly; a delivery tray having a receiving recess and being mounted in said structure for movement from a position in which said receiving recess is below to a position in which said receiving recess is away from the dispensing opening of the shell but accessible from the open front of said structure to permit pick-up of dispensed items, respectively.

3. Apparatus according to claim 2, wherein the delivery tray has a portion thereof provided with a through-passage positioned to be brought into alignment with the dispensing opening of the shell when the delivery tray is in the position in which the receiving recess is accessible from the open front of the supporting and protective structure to provide for introduction of items into the respective individual compartments.

4. Apparatus for dispensing a multiplicity of items in sequence, comprising an elongate cylindrical container element; means mounting said container element for simultaneous rotation and axial movement on a substantially horizontal axis so that any point on its circumferential surface executes progressive spiral travel; means for effecting said rotation and axial movement comprising a reversible stepper electric motor over and along which said container element moves concentrically back and forth during its spiral travel; a series of recesses in said container element opening into the outer circumferential surface thereof and extending along the length thereof in spiral formation as item-receiving compartments; an item-retaining shell with which said container element is closely fitted for said rotation and axial movement, said shell having a dispensing opening substantially corresponding to a compartment opening, said dispensing opening being located within the path of spiral travel of the series of compartment openings; and a programmable information storage and control system including microprocessor means for operating the means for effecting rotation and axial movement of the container element on a sequentially timed basis; said container element, said means for effecting movement of said container element, and said item-retaining shell being mounted within a supporting structure having mutually opposite end walls; and the means mounting said container element comprises a stationary cylindrical cam having a spiral trackway and being cantilevered from one of said end walls, said motor being cantilevered from the other of said ends walls in driving connection with said container element.

5. Apparatus for dispensing a multiplicity of items in sequence, comprising an elongate cylindrical container element; means mounting said container element for simultaneous rotation and axial movement on a substantially horizontal axis so that any point on its circumferential surface executes progressive spiral travel; means for effecting said rotation and axial movement comprising a reversibile stepper electric motor over and along which said container element moves concentrically back and forth during its spiral travel; a series of recesses in said container element opening into the outer circumferential surface thereof and extending along the length thereof in spiral formation as item-receiving compartments; an item-retaining shell within which said container element is closely fitted for said rotation and axial movement, said shell having a dispensing opening substantially corresponding to a compartment opening, said dispensing opening being located within the path of spiral travel of the series of compartment openings; and a programmable information storage and control system including microprocessor means for operating the means for effecting rotation and axial movmement of the container element on a sequentially timed basis; the container element, the means for effecting movement of said container element, and the item-retaining shell being mounted within a supporting and protective structure having an open front with the dispensing opening facing downwardly; a delivery tray having a receiving recess and being mounted in said structure for movement from a position in which said receiving recess is below to a position in which said receiving recess is away from the dispensing opening of the shell but accessible from the open front of said structure to permit pick-up of dispensed items, respectively; and a limit switch positioned to be operable by the delivery tray when moved to provide access to the items delivered to the delivery tray, said information storage and control system including means for indicating that dispensed items are waiting to be removed from the delivery tray, means for indicating that dispensed items have been removed from the machine, and means for nullifying the indication that dispensed items are waiting to be removed, said limit switch being connected in said information storage and control system so as to operate both said indicating means and said nullifying means.

* * * * *